United States Patent [19]

Magee

[11] 4,101,007

[45] Jul. 18, 1978

[54] CONTROL SYSTEM FOR LIMITING ELEVATOR CAR MOVEMENT SPEED UNLESS CAR DOORS ARE FULLY CLOSED

[76] Inventor: John E. Magee, 191 Forest Blvd., Ardsley, N.Y. 10502

[21] Appl. No.: 737,471

[22] Filed: Nov. 1, 1976

[51] Int. Cl.[2] ..... B66B 5/06

[52] U.S. Cl. ..... 187/29 R

[58] Field of Search ..... 187/29

[56] References Cited

U.S. PATENT DOCUMENTS

| | | | |
|---|---|---|---|
| 1,934,867 | 11/1933 | Lindstrom et al. | 187/29 |
| 1,944,471 | 1/1934 | Seeger | 187/29 |
| 2,867,292 | 1/1959 | Bruns | 187/29 |
| 3,587,785 | 6/1971 | Krauer et al. | 187/29 |
| 3,882,969 | 5/1975 | Podcameni et al. | 187/29 |

*Primary Examiner*—Robert K. Schaefer
*Assistant Examiner*—W. E. Duncanson, Jr.
*Attorney, Agent, or Firm*—Brooks, Haidt, Haffner & Delahunty

[57] ABSTRACT

Safety controls for an elevator car in which a switch which is closed when the elevator car door is at least partly open is connected to a relay which interrupts the power to the motor of the car hoisting apparatus when the car speed exceeds a safe value. The switch and relay are connected in series to the hoisting apparatus motor armature, the voltage on which is proportional to the speed thereof and alternatively may be connected in series with a centrifugal switch driven by the hoisting apparatus motor. The relay may also actuate the motor brake and may be included in a lockup circuit which is manually resettable by an attendant.

6 Claims, 5 Drawing Figures

CONTROL SYSTEM FOR LIMITING ELEVATOR CAR MOVEMENT SPEED UNLESS CAR DOORS ARE FULLY CLOSED

This invention relates to control systems for elevator cars and particularly, to apparatus for preventing an elevator car from exceeding a predetermined safe speed when ever its doors are not closed.

Elevator controls systems are well-known in the art and usually include switches operable to indicate whether or not the car doors are closed, hoisting apparatus including a variable speed drive and various switches to determine the direction of movement and destination of the elevator car. Normally, the switches operable to indicate whether or not the car doors are closed will control associated circuits so as to prevent movement of the car unless the doors are fully, or almost fully, closed. Also, it is customary to arrange the hoisting apparatus drive so that the elevator car approaches a destination floor or departs from a floor relatively slowly and moves relatively rapidly between floors.

In systems having switches which are intended to prevent movement of the elevator car until the doors are fully closed, it can happen that the switches become by-passed due to faulty operation or accidental grounding thereof. In such event, the elevator car may depart from a floor at relatively high speed even with the car doors at least partially open.

In those systems in which the elevator car is permitted slow movement when the car doors are at least partially open, defective controls can permit the car to move at high speed when the doors are not closed.

Similarly, with complex are levelling controls which can malfunction and with the opening of the field winding of a hoisting motor, the elevator car may move rapidly from a floor at times when such movement is hazardous to passengers or intending passengers.

One object of the invention is to detect an unsafe or hazardous speed of movement of an elevator car when its doors are not fully closed, and when such movement is detected, to stop the movement of the elevator car.

Another object of the invention is to prevent further use of an elevator car which has moved at an unsafe or hazardous speed when its doors are not fully closed until further use thereof is initiated by authorized personnel.

In accordance with the preferred embodiment of the invention, switches are associated with the doors of elevator cars so that they are opened only when the doors are fully closed. Such switches control circuits which are responsive to the speed of car movement and which stop the hoisting apparatus when the car doors are not fully closed and the speed of car movement exceeds selected safe speed. Preferably, the control circuits maintain the hoisting apparatus in its stopped condition until a further switch, operable only by authorized personnel, is operated.

Other objects and advantages of the present invention will be apparent to those skilled in the art from the following description of the presently preferred embodiments, which description should be considered in conjunction with the accompanying drawings in which:

FIG. 1 is a block diagram of the control system of the invention;

FIG. 2 is a simplified, schematic wiring diagram illustrating the additions to and the modification of certain circuits of the elevator control system illustrated and described in U.S. Pat. No. 1,680,711, required to obtain the objects of the invention;

Figure 1:
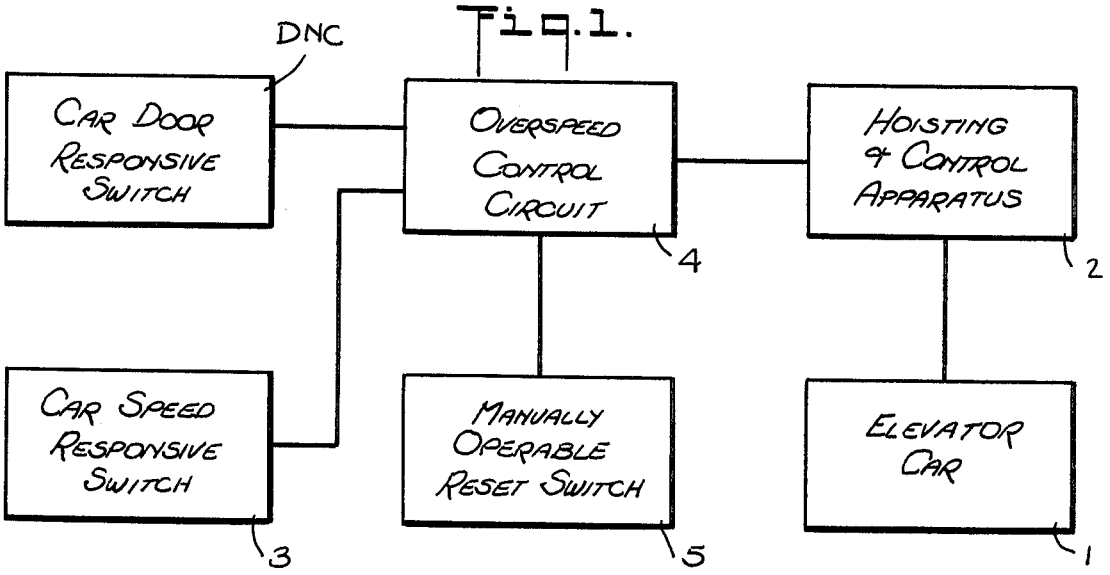

FIG. 1 illustrates schematically the principles of the invention and illustrates a conventional elevator car 1, normally having a pair of access doors which are moved between opened and closed positions in a conventional manner. The car 1 is raised and lowered in a hoistway by hoisting and control apparatus 2 which controls the movement of the car 1 in a manner well-known to those skilled in the art. The apparatus 2 normally includes means for moving the car 1 at at least two different speeds and means for levelling the car 1 and stopping it at a floor.

The system of the invention includes a car door responsive switch DNC which may be contacts of a switch already present in a conventional elevator system, or may be a switch added to a conventional elevator system. In the preferred embodiment of the invention, the switch DNC is opened only when the car doors are fully closed in order that the chances that the invention will be made inoperative by by-passing, faulty operation or grounding of the switch DNC will be reduced. However, the invention is also useful when the switch DNC is closed only when the car doors are fully closed provided that such closing of the switch DNC is utilized in an obvious manner to initiate the operations hereinafter described. Preferably, also, the contents of the switch DNC close by reason of gravity when the car doors are not fully closed.

The system of the invention also includes a car speed responsive circuit 3 which detects the speed of movement of the car 1. There are, of course, many ways in which such speed can be detected. For example, when the hoisting apparatus is driven by a direct current motor, the car speed usually is proportional to the magnitude of the voltage applied to the armature of such motor. The speed of the car 1 may also be detected in other conventional ways, such as by a tachometer generator or a centrifugal switch operated from the hoisting apparatus, or by a counter operable by the hoisting apparatus.

The system of the invention also includes an overspeed control circuit 4 which is controlled by the switch DNC and the car speed responsive circuit 3 so that if the switch DNC is closed and the speed of movement of the car 1 exceeds a value which is slightly greater than the value normally used for levelling of the car, e.g., 5–15% above the normal maximum levelling speed, the circuit 3 will stop the movement of the car 1 by means of the hoisting and control apparatus. However, as long as either the switch DNC is open (i.e., the car doors are fully closed) or the car movement speed does not exceed said safe value when the switch DNC is closed, the operation of the hoisting and control apparatus 2 will continue in its normal manner.

The preferred embodiment of the invention also includes in the circuit 4 a lockup circuit so that if the circuit 4 causes stopping of the car 1, because of overspeeding thereof with the switch DNC closed, the hoisting and control apparatus 2 remains inoperative and the car 1 remains stopped until an attendant or mechanic has investigated the cause of the problem, corrected the problem and put the car 1 back into service. The lockup circuit may be released by means of the manually operable reset switch 5 which may, for example, be a key operable switch spring loaded into the closed position or a simple switch biased into its closed position but located in a position inaccessible to the general public.

Accordingly, in the system of the invention, the car 1 will be stopped when the speed of movement thereof exceeds a safe value above a normal value and the doors of the car 1 are not fully closed. In the preferred embodiment of the invention, the car 1 will remain stopped until an attendant or mechanic returns the car 1 to service by means of the reset switch 5.

It will be obvious to those skilled in the art that the control system of the invention may be used with various types of dispatching and/or control systems now used in the art, including control systems for single or multiple elevator car installations. For purposes of simplification, a specific embodiment of the invention will be described by reference to, and operation in conjunction with, the system of control described in said U.S. Pat. No. 1,680,771. It will be understood, however, that the description of the invention in conjunction with the control system of said patent is merely for purposes of illustration.

In the description hereinafter given, it will be assumed that the elevator system comprises the circuits, controls, mechanisms, etc. set forth in said U.S. Pat. No. 1,680,771 modified as set forth hereinafter to include the circuits and controls of the present invention. Accordingly, the description of the operation of the system set forth in said U.S. Pat. No. 1,680,771 will not be repeated herein, and the description and drawing will herein be limited to the modifications of the system set forth in said U.S. Pat. No. 1,680,771 required to adapt the present invention thereto and to certain portions of the system of said U.S. Pat. No. 1,680,771 with which the modifications cooperate.

Switches and relays employed in the embodiments disclosed in the drawings and not shown in said U.S. Pat. No. 1,680,771 are as follows:

DNC — Car door controlled switch; open only when car door fully closed

OSP — Car speed responsive relay

LO — Lockout relay

LOK — Manually operable switch $CF_1$ — Centrifugal switch

Figure 2:
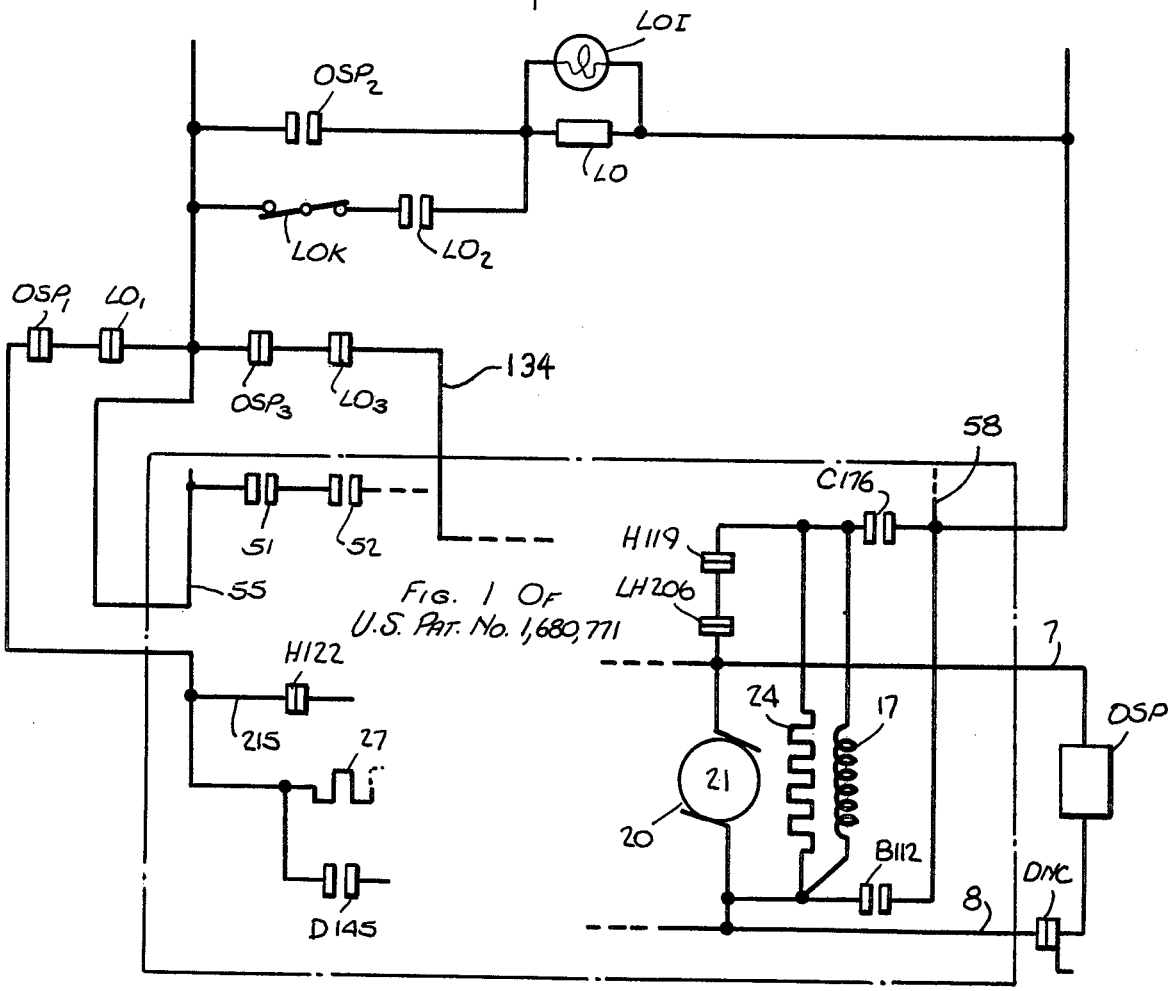
Figure 4:
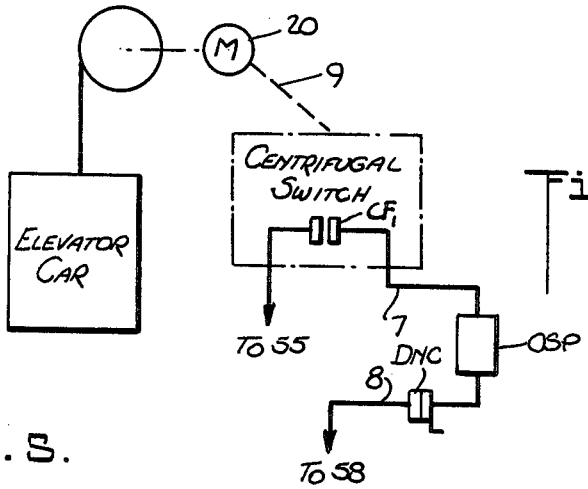
FIG. 4 is a simplified, schematic diagram illustrating a modification of a portion of the embodiment illustrated in FIG. 2.

In the embodiment shown in FIG. 2, the circuit of FIG. 1 of said patent is modified to insert the normally closed contacts $OSP_1$ and $LO_1$ in series between the line 55 and the contacts H122, the contacts D145 and the resistor 27 and to insert the normally closed contacts $OSP_3$ and $LO_3$ in series between the line 55 and the line 134. The reference numerals and components within the rectangles in FIGS. 2 and 4 are those shown in FIG. 1 of said patent.

As described in said U.S. Pat. No. 1,680,771, the armature 21 is part of a direct current hoisting motor 20 which is energized from a direct current generator driven by a motor energized from the lines 55 and 58. The contacts C176 and B112 are part of circuits controlling the direction of rotation of the motor 20, the winding 17 is a field winding of said generator and the resistance 24 is a discharge resistance for the winding 17. The contacts H119, H122 and LH206 are controlled by car brake and levelling brake relays. The resistance 27 controls the strength of the field of said generator and hence, the voltage applied to the armature 21. The contacts D145 are controlled by an accelerating relay. The line 134 is in series with the release coil for the electromagnetic brake for the motor 20, and the contacts 51 and 52 are operable by the elevator door and close when the door is fully closed.

From a study of the description of the circuits in said U.S. Pat. No. 1,680,771, several points will be noted as follows:

(1) The up and down levelling coils LB188 and LC228 and the levelling brake and field switch coil LH190 are not subject to the condition of the door operated contacts 51 and 52.

(2) If the line 55 is a system grounded line and the side of the door operated contacts 51 away from the line 55 becomes grounded unintentionally, the system will operate even if the car doors are not closed.

(3) The car door commences opening prior to the time that the car levels to a floor (see page 8, lines 98–128).

(4) In the embodiment of FIG. 6, the same generator field coil 17 is used for both low speed and high speed car movement and a control misoperation could cause high speed movement of the car during levelling.

Thus, it is apparent that the elevator car can move without the car door being fully closed and can move at a speed higher than a safe speed when the car door is fully closed. The control system of the invention substantially eliminates the possibility that an elevator car will move at speeds higher than a safe speed when the car door is not fully closed.

In the preferred embodiment illustrated in FIG. 2, the relay OSP is connected to the armature 21 of the motor 20 through the switch DNC and by the leads 7 and 8, so that when the switch DNC is closed, i.e., when the doors of the elevator car are not fully closed, the voltage applied to the armature 21 is also applied to the relay OSP. The relay OSP is selected so that it will be actuated when the voltage applied thereto results in a speed of the motor 20 which exceeds a value slightly greater than the normal maximum levelling speed, e.g., 5–15% higher than such levelling speed. Of course, if the elevator system is designed so that there should be no movement of the car with the door open, the relay OSP may be selected so that it actuates whenever there is a voltage, or a low voltage, on the armature 21 and the switch DNC is closed to provide a back-up system in the event of misoperation of the normal controls.

When the relay OSP is actuated, it opens its normally closed contacts $OSP_1$ which interrupt the electric power supplied to the motor 20, as would contacts B112 or C176, and opens its normally closed contacts $OSP_3$ which causes the electricallyoperable brake for the motor 20 to stop rotation of the armature 21. In some cases, it may be sufficient merely to interrupt the supply of electric power to the motor 20 without applying the brake to the motor 20, in which the case contacts $OSP_3$ may be omitted.

At its normally open contacts $OSP_2$, a circuit is completed for actuating the relay LO which closes its normally open contacts $LO_2$ and opens its normally closed contacts $LO_1$ and $LO_3$, the latter two contacts being in series, respectively, with the contacts $OSP_1$ and $OSP_3$.

Thus, as long as the relay LO is energized the circuit for supplying electric power to the motor 20 is open and the circuit for releasing the brake to the armature 21 is open. The relay LO is maintained in its energized condition by reason of an obvious lockup circuit including a manually operable switch LOK of the type described hereinbefore, and the contacts $LO_2$. Accordingly, until the switch LOK is actuated to open the lockup circuit, the elevator car remains in the position at which it has been stopped by reason of de-energization of the motor 20 and setting of the motor brake. A lamp LOI may be connected in parallel with the relay LO and may be located so as to be observed by an attendant and, for example, may be located on a panel in the lobby of the building in which the elevator car is installed, or may be located in a superintendent's office in such building.

Figure 3:
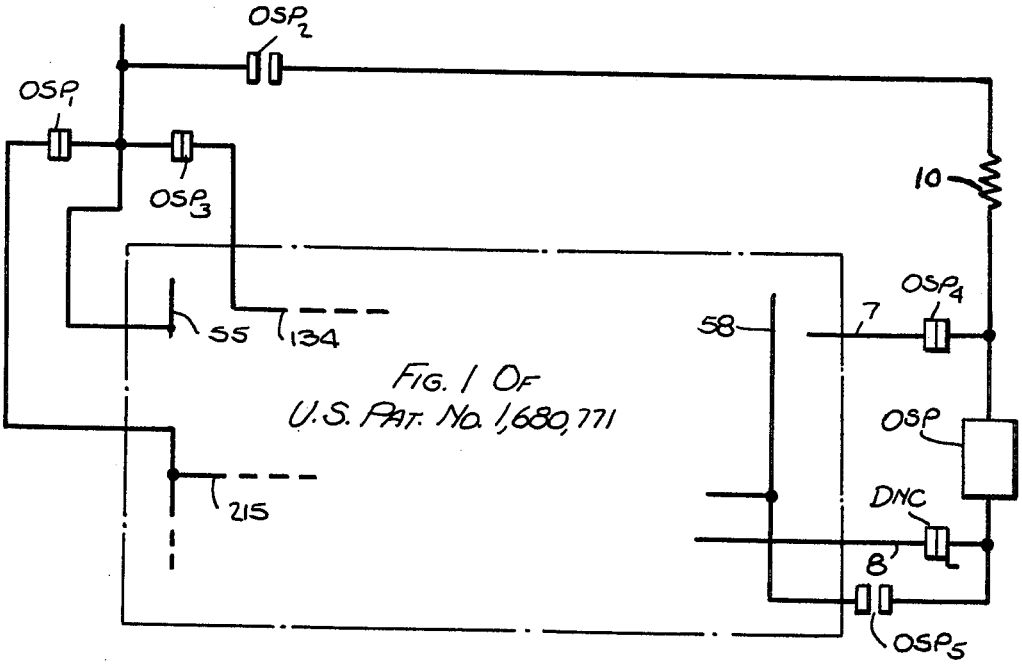
FIG. 3 is a simplified, schematic diagram illustating a modification of a portion of the embodiment illustrated in FIG. 2.

Although it is preferred to provide all of the circuits described hereinbefore in connection with FIG. 2, the relay LO and its associated contacts and the manually operable switch LOK may be omitted. FIG. 3 illustrates such modification of the system shown in FIG. 2, and in FIG. 3 the operation of the system to stop the elevator car is the same as that described in connection with FIG. 2. However, when the supply of voltage to the armature 21 is discontinued by reason of the opening of the contacts $OSP_1$, the relay OSP would be de-energized in the system shown in FIG. 2. Therefore, to lockup the relay OSP, the relay OSP may be provided with contacts $OSP_4$ and $OSP_5$ connected as shown in FIG. 3. Thus, when the normally open contacts $OSP_2$ and $OSP_5$ are closed upon actuation of the relay OSP, an obvious lockup circuit, including a current limiting resistor 10, is completed for maintaining the relay OSP actuated. In order to avoid application of the voltage of the source which maintains the relay OSP actuated to the armature 21, normally closed contacts $OSP_4$ are connected in series with the switch DNC and the relay OSP. Of course, if the relay OSP is a latching relay, the contacts $OSP_2$ and $OSP_5$ may be omitted. Thus, in the embodiment of FIG. 3, when the elevator car is stopped it will be maintained in its stopped position until the relay OSP is de-energized, such as by opening the switch 47 described in said U.S. Pat. No. 1,680,771.

In the embodiments previously described, the relay OSP is actuated by a predetermined level of voltage applied to the armature 21 of the hoist drive motor 20. As illustrated in FIG. 4, the relay OSP may be actuated by means of a centrifugal switch connected to the motor 20 as indicated by the dotted line 9. Thus, when the speed of rotation of the armature 21 of the motor 20 reaches a predetermined value, the contacts $CF_1$ close completing a circuit through the switch DNC which causes energization and actuation of the relay OSP. The relay OSP actuated by the contacts $CF_1$ may be employed to stop the elevator car in the manner described in connection with FIGS. 2 and 3.

Figure 5:
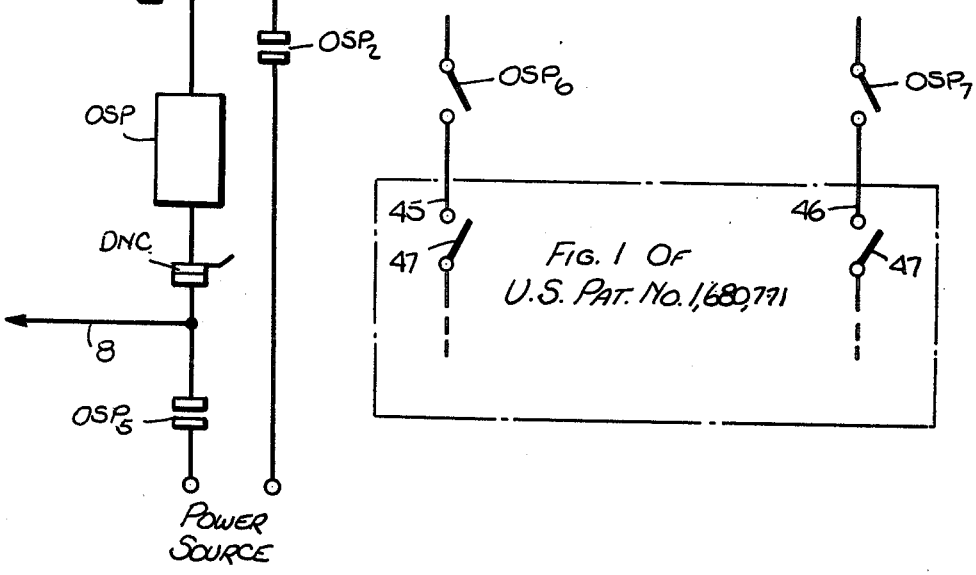
FIG. 5 is a simplified, schematic diagram illustrating a modified embodiment of the invention.

In conventional elevator systems the car is normally stopped whenever the supply of power to the system is interrupted. Instead of merely actuating the motor brake and discontinuing the supply of electric power to the motor, as described in connection with FIGS. 2 and 3, the relay OSP may be employed to interrupt the power to the elevator system, which will cause the car to stop. FIG. 5 illustrates a circuit for utilizing the relay OSP to interrupt the power to the elevator system.

In FIG. 5, the relay OSP is in a circuit corresponding to the circuit associated therewith shown in FIG. 3, and the connecting lines 7 and 8 may be either connected to the armature 21, as described in connection with FIGS. 2 and 3, or to the centrifugal switch contacts $CF_1$, as described in connection with FIG. 4. When the relay OSP is actuated as described hereinbefore, contacts $OSP_6$ and $OSP_7$ thereof, which are connected in series with the mains 45 and 46 for the elevator system described in said U.S. Pat. No. 1,680,771, interrupt the supply of electric power to the elevator system and thereby cause the elevator car to stop. As in the embodiment illustrated in FIG. 3, the contacts $OSP_2$ and $OSP_5$ may be omitted if relay OSP is a latching relay. Also, in this embodiment, contacts $OSP_4$ may be omitted because of the interruption of the electric power on the mains 45 and 46.

Although perferred embodiments of the present invention have been illustrated and described, it will be apparent to those skilled in the art that various modifications may be made without departing from the principles of the invention.

What is claimed is:

1. In an elevator system having an elevator car with at least one door and means for moving said door to an open position and to a closed position and hoisting apparatus for raising and lowering said car, said hoisting apparatus including a drive motor for moving said car and speed control means for setting the speed at which said drive motor moves said car, the combination therewith of door responsive means responsive to the movement of said door to said closed position, speed control responsive means connected to said speed control means and responsive thereto when said control means sets the speed of movement of said car at a value above a predetermined value, and overspeed control means connected to said door responsive means, said speed control responsive means and said hoisting apparatus for stopping said hoisting apparatus when said door is away from said closed position thereof and said speed control means sets said speed of movement of said car at a value which exceeds said predetermined value.

2. In an elevator system as set forth in claim 1, wherein said door responsive means comprises switch means mounted to be operable by said door in the closed position thereof for opening said switch means, and wherein said overspeed control means comprises means interconnecting said switch means and said speed control responsive means and connected to said hoisting apparatus for stopping the latter when said switch means is not actuated and said speed control responsive means is actuated.

3. In an elevator system as set forth in claim 1, wherein said drive motor is an electric drive motor which is variable in speed by the voltage applied thereto, an increase in voltage causing an increase in speed, and said hoisting apparatus comprises electric power means for supplying electric power to said motor, wherein said door responsive means comprises switch means mounted to be operable by said door in the closed position thereof for actuating said switch means, wherein said speed control responsive means comprises a voltage responsive relay having a plurality of contacts, means connecting said switch means and said voltage responsive relay to said motor so that when said switch means is not actuated said voltage applied to said motor is applied to said voltage responsive relay which is actuated when said voltage exceeds a predetermined value, and wherein said overspeed control means comprises means connecting contacts of said voltage responsive relay in circuit with at least said electric power means for stopping said motor.

4. In an elevator system having an elevator car with at least one door and means for moving said door to an open position and to a closed position and hoisting apparatus for raising and lowering said car, said hoisting apparatus comprising an electric drive motor which is variable in speed by the voltage applied thereto, an increase in voltage causing an increase in speed, electric power means for supplying electric power to said motor and electrically operable brake means for stopping said hoisting apparatus, the combination therewith of door responsive means responsive to the movement of said door to said closed position, said door responsive means comprising normally closed switch means mounting to be operable by said door in the closed position thereof for opening said switch means, speed responsive means responsive to the speed of movement of said car, said speed responsive means comprising a voltage responsive relay having a plurality of contacts, means connecting said switch means and said voltage responsive relay in series and to said motor so that when said switch means is closed, said voltage applied to said motor is applied to said voltage responsive relay which is actuated when said voltage exceeds a predetermined value, and overspeed control means connected to said door responsive means, said speed responsive means and said hoisting apparatus for stopping said hoisting apparatus when said door is away from said closed position thereof and said speed of movement of said car exceeds a predetermined value, said overspeed control means comprising means connected contacts of said voltage responsive relay in circuit with said electric power means and said brake means for interrupting the supply of electric power to said motor and for actuating said brake means to stop said motor, and lockup circuit means including contacts of said voltage responsive relay in circuit with said last-mentioned relay to maintain said last-mentioned relay actuated when it has been actuated by voltage applied to said motor.

5. In an elevator system having an elevator car with at least one door and means for moving said door to an open position and to a closed position and hoisting apparatus for raising and lowering said car, said hoisting apparatus comprising an electric drive motor which is variable is speed by the voltage applied thereto, an increase in voltage causing an increase in speed, electric power means for supplying electric power to said motor and electrically operable brake means for stopping said hoisting apparatus, the combination therewith of door responsive means responsive to the movement of said door to said closed position, said door responsive means comprising normally closed switch means mounted to be operable by said door in the closed position thereof for opening said switch means, speed responsive means responsive to the speed of movement of said car, said speed responsive means comprising a voltage responsive relay having a plurality of contacts, and means connecting said switch means and said voltage responsive relay in series and to said motor so that when said switch is closed, said voltage applied to said motor is applied to said voltage responsive relay which is actuated when said voltage exceeds a predetermined value, and overspeed control means connected to said door responsive means, said speed responsive means and said hoisting apparatus for stopping said hoisting apparatus when said door is away from said closed position thereof and said speed of movement of said car exceeds a predetermined value, said overspeed control means comprising means connecting contacts of said voltage responsive relay in circuit with said electric power means and said brake means for interrupting the supply of electric power to said motor and for actuating said brake means to stop said motor, a further relay having a plurality of contacts, means connected contacts of said voltage responsive relay in circuit with said further relay for actuating the latter upon actuation of said voltage responsive relay, means connecting contacts of said further relay in circuit with said electric power means and said brake means for interrupting the supply of electric power to said motor and for actuating said brake means to stop said motor, and lockup circuit means including contacts of said further relay and a manually operable switch connected in circuit with said further relay to maintain said further relay actuated when it has been actuated by said contacts of said voltage responsive relay.

6. In an elevator system having an elevator car with at least one door and means for moving said door to an open position and to a closed position and hoisting apparatus for raising and lowering said car, the combination therewith of switch means responsive to the movement of said door to said closed position, said switch means being normally closed and being mounted to be operable by said door in the closed position thereof for opening said switch means, speed responsive means responsive to the speed of movement of said car, and overspeed control means connected to said door responsive means, said speed responsive means and said hoisting apparatus for stopping said hoisting apparatus when said door is away from said closed position thereof and said switch means is closed and said speed of movement of said car exceeds a predetermined value.

* * * * *

UNITED STATES PATENT AND TRADEMARK OFFICE

CERTIFICATE OF CORRECTION

PATENT NO. : 4,101,007

DATED : July 18, 1978

INVENTOR(S) : John E. Magee

It is certified that error appears in the above-identified patent and that said Letters Patent are hereby corrected as shown below:

Col. 2, line 2 "1,680,711" should read "1,680,771"

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*